US007997941B2

(12) United States Patent
Pfaffenbach et al.

(10) Patent No.: US 7,997,941 B2
(45) Date of Patent: Aug. 16, 2011

(54) PLUG CONNECTOR

(75) Inventors: Dirk Pfaffenbach, Halver (DE); Dirk Pellizari, Wuppertal (DE); Sandra Wiegen, Halver (DE); Frank Rentrop, Lüdenscheid (DE)

(73) Assignee: Lumberg Connect GmbH, Schalksmuehle (DE)

( * ) Notice: Subject to any disclaimer, the term of this patent is extended or adjusted under 35 U.S.C. 154(b) by 0 days.

(21) Appl. No.: 12/589,886

(22) Filed: Oct. 29, 2009

(65) Prior Publication Data

US 2010/0144206 A1 Jun. 10, 2010

(30) Foreign Application Priority Data

Oct. 30, 2008 (DE) ..... 10 2008 054 015

(51) Int. Cl.
*H01R 13/64* (2006.01)

(52) U.S. Cl. ..... 439/680

(58) Field of Classification Search ..... 439/680, 439/681, 677–679
See application file for complete search history.

(56) References Cited

U.S. PATENT DOCUMENTS

| | | | | |
|---|---|---|---|---|
| 3,184,707 | A * | 5/1965 | Anderson | 439/681 |
| 3,566,340 | A | 2/1971 | Jayne et al. | |
| 3,576,519 | A * | 4/1971 | Janye et al. | 439/633 |
| 4,595,250 | A * | 6/1986 | Joly et al. | 439/61 |
| 4,986,769 | A * | 1/1991 | Adams et al. | 439/681 |
| 5,019,947 | A * | 5/1991 | Pelzl | 361/802 |
| 5,114,363 | A * | 5/1992 | Mitra | 439/491 |
| 5,184,961 | A * | 2/1993 | Ramirez et al. | 439/59 |
| 5,315,487 | A * | 5/1994 | Le Goe et al. | 361/796 |
| 5,370,556 | A * | 12/1994 | Olsson | 439/681 |
| 5,387,132 | A * | 2/1995 | Sarver et al. | 439/633 |
| 5,421,734 | A * | 6/1995 | MacWilliams | 439/59 |
| 5,441,426 | A * | 8/1995 | Boulais | 439/681 |
| 5,688,147 | A * | 11/1997 | Coteus et al. | 439/681 |
| 6,017,248 | A * | 1/2000 | Pan et al. | 439/681 |
| 6,165,025 | A * | 12/2000 | Meng | 439/681 |
| 6,485,336 | B1 * | 11/2002 | Zebermann et al. | 439/680 |
| 6,503,108 | B1 | 1/2003 | Kikuchi et al. | |
| 6,716,045 | B2 * | 4/2004 | Meredith | 439/181 |
| 7,559,807 | B2 * | 7/2009 | Freimuth et al. | 439/717 |
| 7,566,234 | B2 * | 7/2009 | Hackemack et al. | 439/188 |
| 7,609,528 | B2 * | 10/2009 | Freimuth et al. | 361/801 |
| 2003/0109177 | A1 * | 6/2003 | Meredith | 439/608 |
| 2006/0134956 | A1 * | 6/2006 | Freimuth et al. | 439/166 |
| 2009/0209140 | A1 * | 8/2009 | Heggemann et al. | 439/680 |

FOREIGN PATENT DOCUMENTS

| | | |
|---|---|---|
| DE | 1 956 095 | 11/1969 |
| DE | 44 20 984 | 12/1995 |
| DE | 196 07 381 C2 | 2/1996 |
| GB | 2 207 564 A | 2/1989 |

* cited by examiner

*Primary Examiner* — T C Patel
*Assistant Examiner* — Vladimir Imas
(74) *Attorney, Agent, or Firm* — Von Rohrscheidt Patents

(57) ABSTRACT

A plug connector comprising a first contact support, in which contacts are disposed, which enter an electrical connection with mating contacts of a second contact support, when the contact supports are joined. The first contact support comprises first coding device, which interacts with a second coding device of the second contact support and assures a defined joining of the contact supports in order to connect the contacts and the mating contacts.

20 Claims, 8 Drawing Sheets

PLUG CONNECTOR

RELATED APPLICATIONS

This application claims priority from and incorporates by reference German patent application serial No. DE 10 2008 054 015.3, filed on Oct. 30, 2008

FIELD OF THE INVENTION

The invention relates to a plug connector with a first contact support, in which contacts are disposed, which enter an electrical connection with mating contacts of a second contact support, when the contact supports are joined, wherein the first contact support includes a first coding device, which interacts with a second coding device of the second contact support and assure defined joining of the contact supports for connecting contacts and mating contacts.

BACKGROUND OF THE INVENTION

A plug connector of this type is known e.g. from DE 196 07 381 C2, which relates to a plug connector according to the Rast 5-Standard. Plug connectors of this type according to the invention can also be provided according to the Rast 2.5-Standard, which differ from the preceding plug connectors substantially only through the width of the contact pattern.

Plug connectors according to the Rast 5- or the Rast 2.5-Standard have become widely used in particular in electrical household- and kitchen appliances, heating system controls and internal system wiring solutions in the automotive industry.

Such plug connectors typically comprise a plug (second contact support) and a plug socket (first contact support), typically in a multi-pole configuration respectively. The term "plug" thus refers to the configuration of the "male" contact component, wherein the "socket" comprises "female" contact components. Since the socket is the component which is e.g. inserted into contact sections of a circuit board or onto a multi-pin strip in the major number of the Rast-plug connectors used on the market, the socket is subsequently designated as plug socket. Consequently, also circuit boards, multi-pin strips are similar are considered as plugs or plug devices according to the invention.

In order to assure an assembly of plug device and plug socket, which is safe against polarity reversal, both components comprise coding devices. In particular for a polarity safe attachment at circuit boards, their coding devices are configured as circuit board recesses or incisions in the contact portion of the circuit board, which vary with respect to their position, length and width. For each coding of a plug section of a circuit board, a mating plug socket is fabricated, whose housing forms coding walls mating with the recesses.

Color coding is used as a supplement for said form of mechanical coding quite frequently. Color markings are disposed at the plug devices, which are configured as adhesive labels, color bars or as colored plug socket housings. Thus, it is indicated for the assembly process that plug sockets, which are identified accordingly, have to be inserted onto the plug devices, e.g. the circuit board, at a location with identical color. Thus, the color marking can be configured as a supplemental optical, quasi redundant coding for unmistakable joining of plug socket and plug device, or it can be used for coding mechanically identically coded plug sockets or plug devices for additional differentiation.

The mechanical coding and the color coding have proven to be particularly advantageous, since a quasi error free assembly, this means a polarity reversal safe assembly of plug device and plug socket is assured. Meanwhile, however, the perception is that the fabrication of such plug connectors requires improvement.

In production, respective batches with a certain mechanical and/or color coding are fabricated. Thereafter setup times are required at the fabrication equipment for fabricating a batch with a different mechanical and/or color coding. As long as the color coding is performed by means of adhesive labels or color bars, this is a process step in need of improvement as well.

BRIEF SUMMARY OF THE INVENTION

It is the object of the invention to simplify the fabrication of plug connectors, in particular of plug connectors with mechanical coding devices.

The object is accomplished by a plug connector according to claim 1, which is in particular characterized in that at least one contact support comprises a receiver for a coding device, configured as a separate component.

It is the essential advantage of the invention that the standard contact supports and the mechanical contact devices can be fabricated separately, so that the setup times of the production equipment are eliminated. Depending on the desired mechanical coding, a contact support with a respective coding is assembled from a standard contact support and from a separate coding device.

It is provided for a substantially permanent disposition of the coding devices, that they can be snap locked in the contact support.

The position stabilized support can be accomplished in that the contact support comprises guides which are engaged by the coding devices in portions.

The invention relates in particular to a plug connector, whose first contact support is a housing of a plug socket. Said housing is advantageously provided with snap lock devices at the bottom for supporting the coding devices.

It is provided that the coding device for the housing is configured as an insertable coding wall, wherein in particular the plug socket housing comprises grooves disposed in pairs relative to said coding wall, which grooves are engaged by partial portions of the coding wall inserted into the plug socket housing for positional stabilization. Thus, it is advantageous when the coding wall comprises snap lock devices in insertion direction for disposing the coding wall in the plug socket housing.

In a particularly preferred embodiment, the coding wall can be used as a face wall for a laterally open plug socket housing.

Since plug sockets with different depths are known, it is provided that the coding wall comprises a shortening section attached through a zone where the material is weakened, by which the coding wall can be shortened when using it in a housing which is by the length of the shortening section less deep, than the length of the coding wall.

It is provided for an additional or alternative fixation of the coding wall, that the coding wall comprises shoulders at its longitudinal side contacting the housing of the plug socket, which shoulders enter a snap lock connection with protrusions in the socket housing.

It is envisioned to use this form of a snap locked connection in particular for coding walls used as a face of the housing.

The plug connector according to the invention is preferably a plug connector according to the Rast 5-Standard or according to the Rast 2.5-Standard.

When the coding device is provided colored, the color coding described supra can be performed by respectively colored coding devices, in particular coding walls. This eliminates setup times for the production of batches of contact supports with different colors.

When the first contact support is configured as a plug socket housing, the second contact support is a plug device, in particular a plug or a circuit board.

BRIEF DESCRIPTION OF THE DRAWINGS

Further advantages of the invention are evident from the subsequent description of the drawings, wherein:

FIGS. 1-4 show the housing of a prior art plug socket and designate it overall with the reference numeral 100.

DETAILED DESCRIPTION

Figure 1:
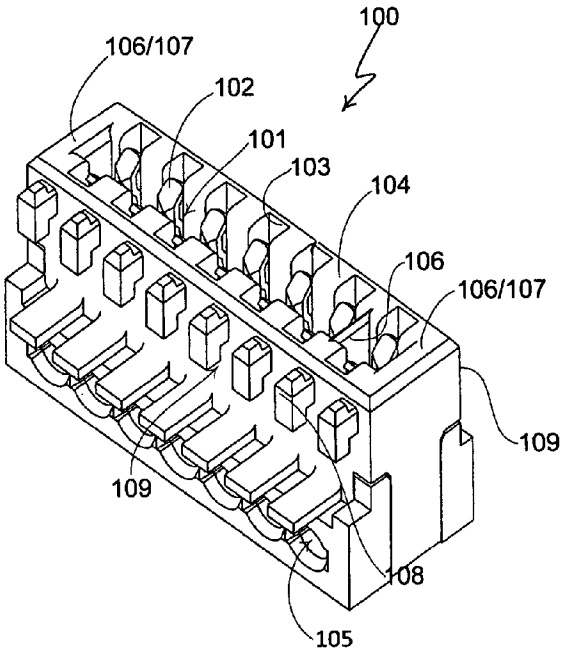
FIG. 1 (Prior Art)
FIGS. 1 & 2 show a contact support according to the invention in the form of a housing of a plug socket in top view or a perspective view with a first mechanical coding.

The housing 100 initially forms a plug-in opening 101 for receiving a plug device which is not shown. The plug-in opening 101 is formed by two parallel walls offset from one another, which walls respectively support a contact spring 102 (contact support walls 109), optional face walls 107 connect the contact support walls 109.

The plug device to be received by the plug-in opening 101 is mostly a plug, a multi-pin strip or a circuit board. Within the plug-in opening 101, a plurality of contact springs 102 is disposed in series adjacent to one another. Said contact springs establish an electrical connection with mating contacts of a plug device, which mating contacts are not shown. The housing 100 itself is made from an insulating material, mostly plastic. The contact support walls 109 form slot shaped recesses 103 for the contact springs 102. The contact springs 102 are electrically insulated from one another by means of material bars 104 formed between the recesses 103.

Cable insertion openings 105 are used for connecting electrical conductors to the contact springs 102. For this purpose, the contact springs 102 comprise clamping contacts with sharp cutting edges at their backs; this means at their sides oriented away from the plug-in opening, by means of which sharp cutting edges the contact springs 102 are contacted with the conductors inserted into the cable insertion opening 105.

The plug socket illustrated in FIG. 1 comprises various coding devices. These are initially coding walls 106, which are integrally configured with the housing 100 within the plug-in opening or as the face wall 107 of the housing. They extend into the housing 100 at least to the bottom. Other coding devices configured as coding lugs 108 are formed on the outer circumference of the housing 100.

As a matter of principle, the core idea of the invention relates to any mechanical coding devices known in the prior art, thus e.g. also the coding lugs 108. It is advantageous as a matter of principle, when the coding devices of the contact supports, e.g. in the form of the housing 100 or the corresponding plug devices, are supported replaceable thereon or therein. When not shown differently, the following drawing description refers to coding devices in the form of coding walls 106 or their equivalents in the subsequent description of the embodiments according to the invention.

Figure 2:
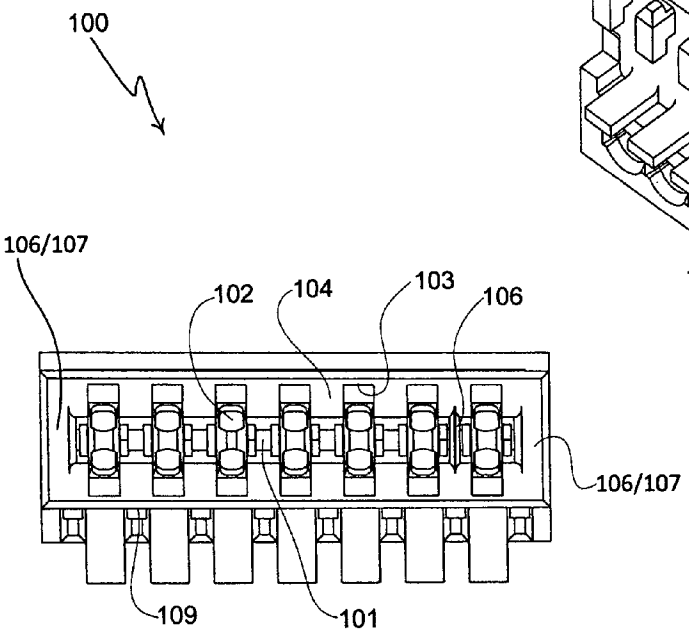
FIG. 2 (Prior Art)
Figure 3:
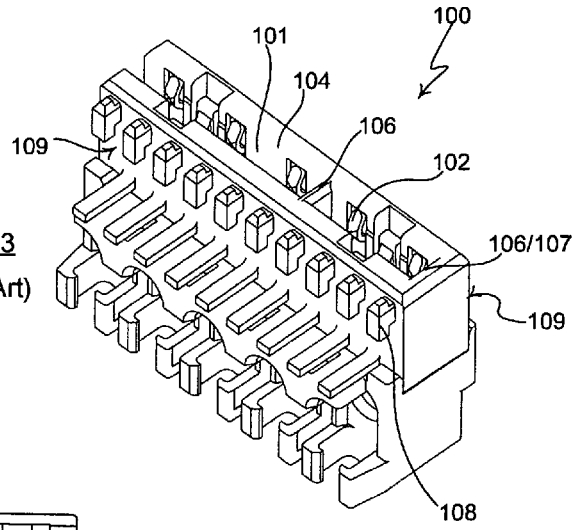
FIG. 3 (Prior Art)
FIGS. 3 & 4 show a housing of a plug socket in top view and in a perspective view with a second mechanical coding.
Figure 4:
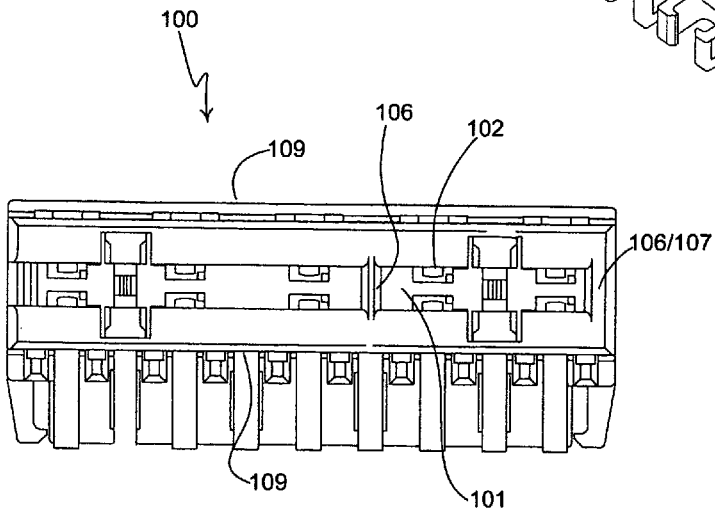
FIG. 4 (Prior Art)

The problem solved by the invention can be described very well, when comparing the prior art embodiments according to FIGS. 1 and 2. The prior art according to FIGS. 1 and 2 comprises three coding walls 106, wherein two coding walls form the face walls 107 of the housing 100. Contrary thereto, the prior art embodiment according to FIGS. 3 and 4 comprises only two coding walls 106, thus one coding wall configured as a face wall 107 and an additional coding wall 106 supported in the plug-in opening. In order to alternate from the production of housings 100 with mechanical coding according to the embodiment of FIGS. 1 and 2 to a plug socket housing 100 with mechanical coding according to FIGS. 3 and 4, a substantial setup effort is required in the production equipment.

With reference to FIGS. 5-12, different embodiments of the invention are being described, which overcome said disadvantage.

For a contact support in the sense of claim 4, the first contact support in the form of a housing of a plug socket is designated herein overall with the reference numeral 10.

The housing 10 of the plug socket comprises a contact support 11 made of an insulating material, in particular plastic, which contact support comprises a plug-in opening 12 for receiving a plug device which is not shown, e.g. a plug, a multi-pin strip or a circuit board section. As shown in the prior art, according to FIGS. 1-4, also the housing according to the invention is formed by two parallel contact support walls 26, which are offset from one another, so that they form a gap, and possibly by face walls 24. Cable insertion openings 13 are configured vertical to the plug-in opening 12, analogous to the reference numeral 105 in the prior art, through which openings conductors, which are not shown, are inserted for electrically contacting contact springs 14 supported in the plug-in opening 12. The contact support 11 of the housing 10 forms cable holders 16 connected to the cable insertion openings 13. The cable ends can be arranged in parallel alignment with the plug-in opening 12 at the contact support 11 by means of the cable supports 16.

The contact support 11 of the housing 10 forms integral coding protrusions 15 on the outer circumference in the outlet portion of the plug-in opening 12. These correspond to the recesses of a mating plug device housing and assure a polarity reversal safe assembly of plug socket housing and plug device housing.

The coding devices designated as 17 are particularly important, which coding devices are inserted into the plug-in opening 12. For this purpose, the contact support walls 26 initially form guide grooves 19, initially disposed in pairs opposite to one another within the plug-in opening 12. Said guide grooves 19 are oriented in the insertion direction of the plug device which is not shown and receive corresponding wall sections 20 of the coding walls 18 for stabilizing their positions. The coding walls 18 are provided with snap lock devices 21 in insertion direction, which are used for anchoring them in the base of the plug-in opening 22.

Figure 5:
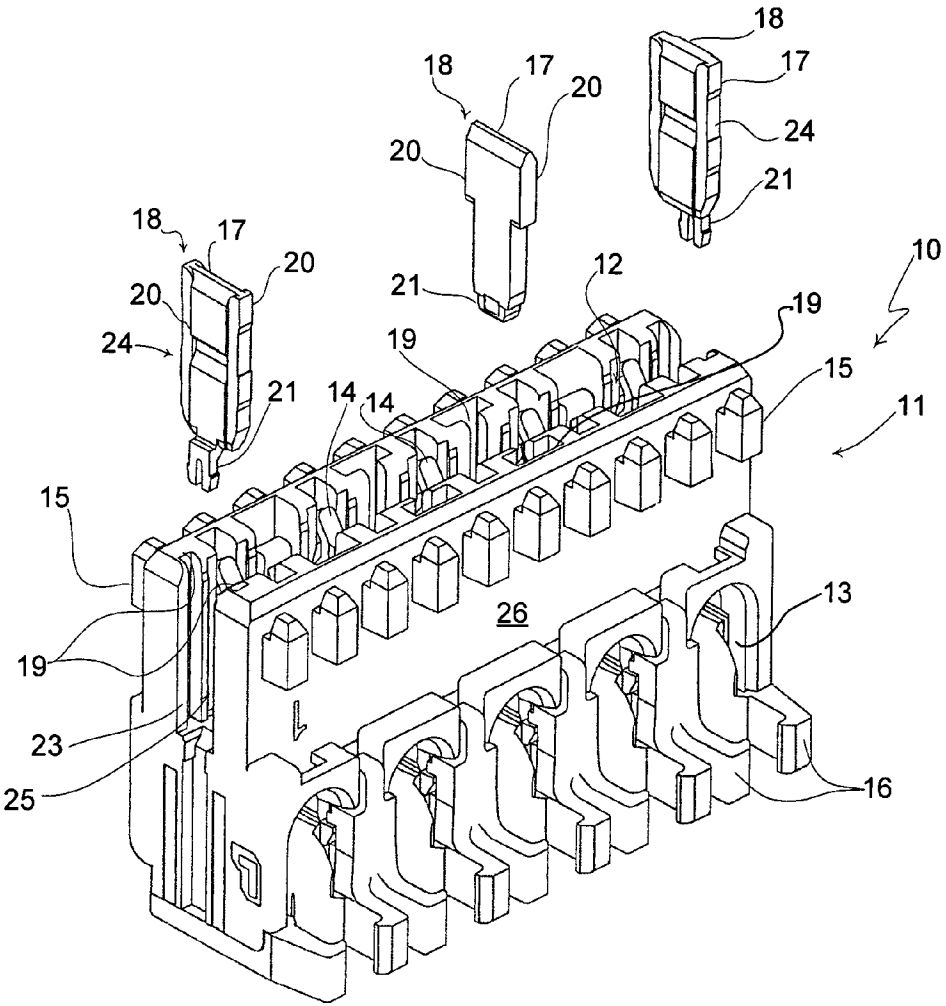
FIG. 5 shows a housing of a plug socket of a plug connector according to the invention with coding bars in an exploded view.
Figure 6:
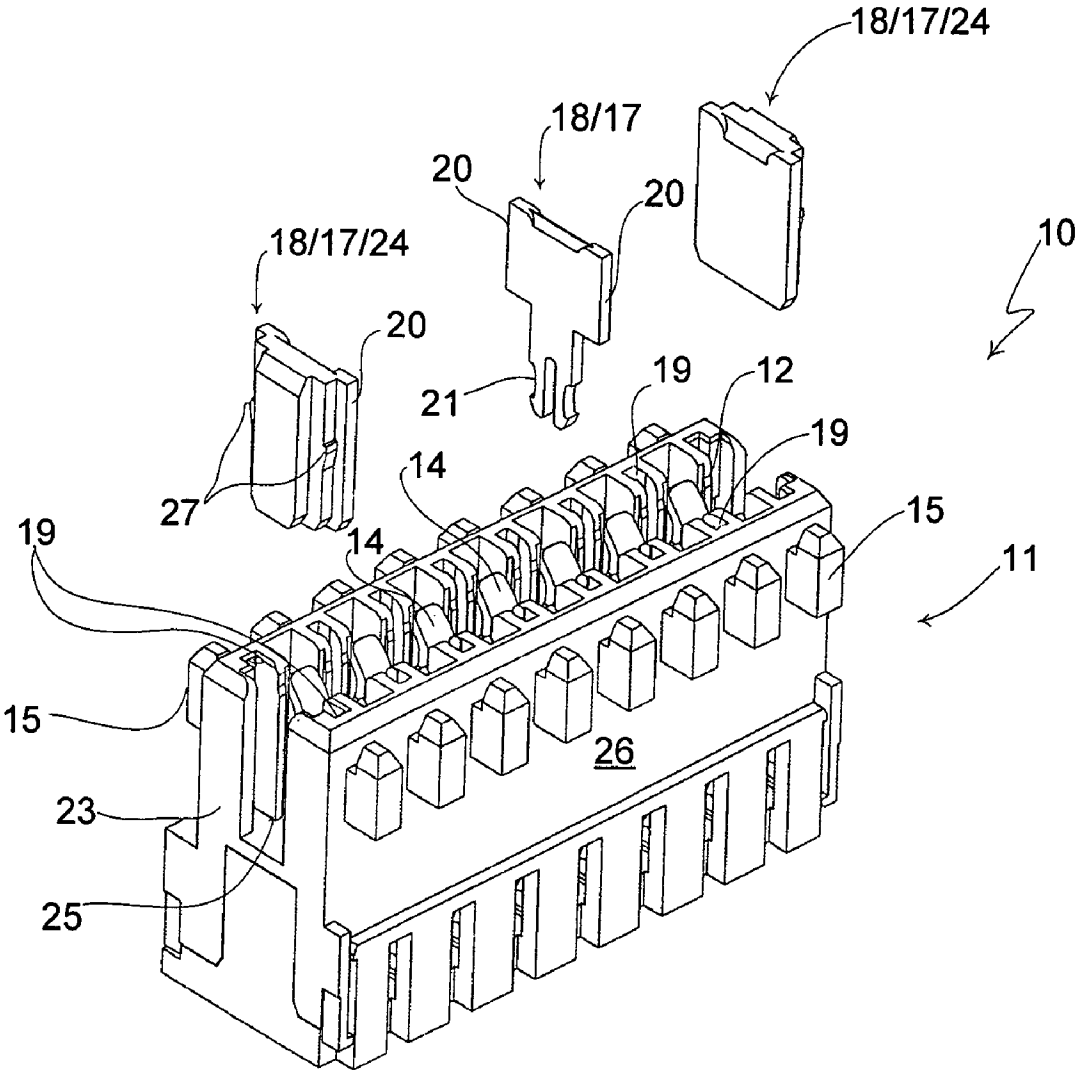
FIG. 6 shows the housing according to FIG. 5 in an alternative embodiment.

As evident from FIGS. 5 and 6, the plug-in opening 12 is open at its narrow sides 23. Particularly configured coding walls 18 form face walls 24 by means of which the narrow sides of the plug-in opening 12 can be closed for plug coding.

FIG. 6 shows a housing 10 according to the invention of a plug socket in a revised embodiment. The housing 10 of FIG. 6 comprises a contact support 11 which is configured slightly different in certain details, wherein only the subsequently described differences are relevant for the invention.

Initially, it is appreciated that the depth of the plug-in opening 12 in the embodiment shown in FIG. 6 is less than the one shown in FIG. 5. The coding walls 18 also used as face walls 24 contrary to those of FIG. 5 do not comprise snap lock devices at their ends disposed in insertion direction. Instead, the wall sections 20 of the face walls 24 oriented in the direction of the contact support walls 26 are provided with snap lock shoulders 27. Said snap lock shoulders 27 reach behind respective protrusions 28 in the guide grooves 19, which, however, are not illustrated in FIG. 6. Due to the smaller depth of the plug-in opening 12, the coding walls 18 are also configured shorter overall.

Figure 7:
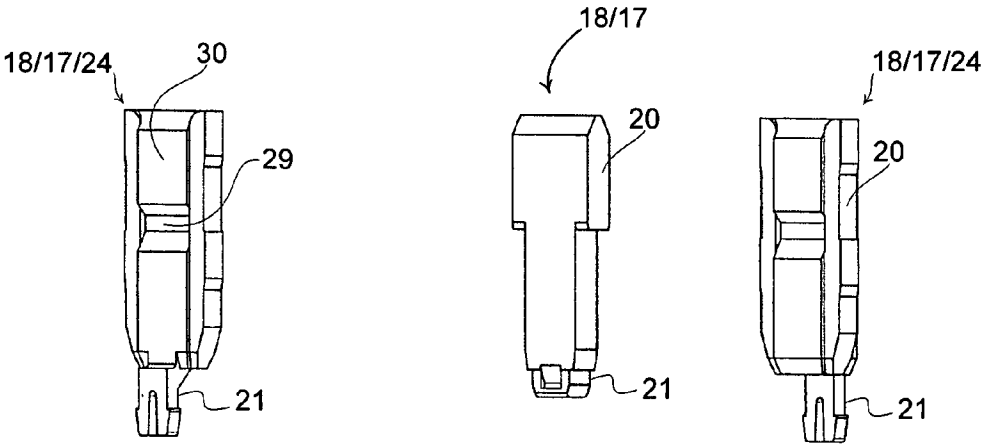
FIG. 7 shows the coding walls according to FIG. 5.
Figure 8:
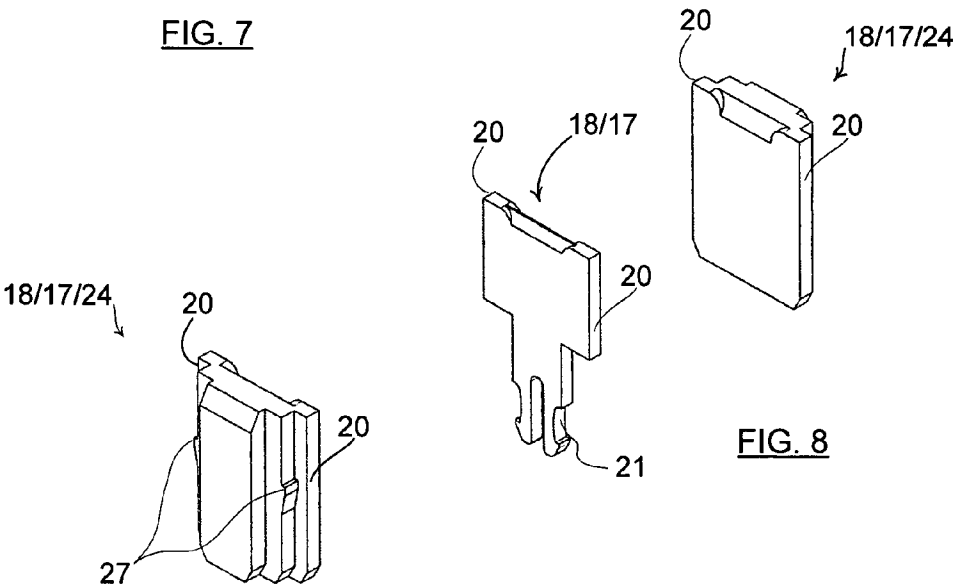
FIG. 8 shows the coding walls according to FIG. 6.

The coding walls 18 according to FIG. 5 are illustrated in FIG. 7. The coding walls 17 according to FIG. 6 are illustrated in FIG. 8. Special attention has to be paid to the coding walls 18 configured as face walls 24 in FIG. 7. These comprise zones with weakened material 29, where a shortening section 30 is connected at the end opposite to the insertion direction or at the end facing away from the snap lock device 21.

In housings 10 according to FIG. 5 with a plug in opening 12, which is less deep, face walls 24 with identical configurations, can be inserted. These then have to be shortened during or after the assembly through separation along the zone of reduced strength material in order to shorten the section 30 (FIG. 7). A similar configuration of the face walls 24 illustrated in FIG. 8 is conceivable, wherein a shortening section which is not shown here is connected at the end opposite to the insertion direction.

Figure 10:
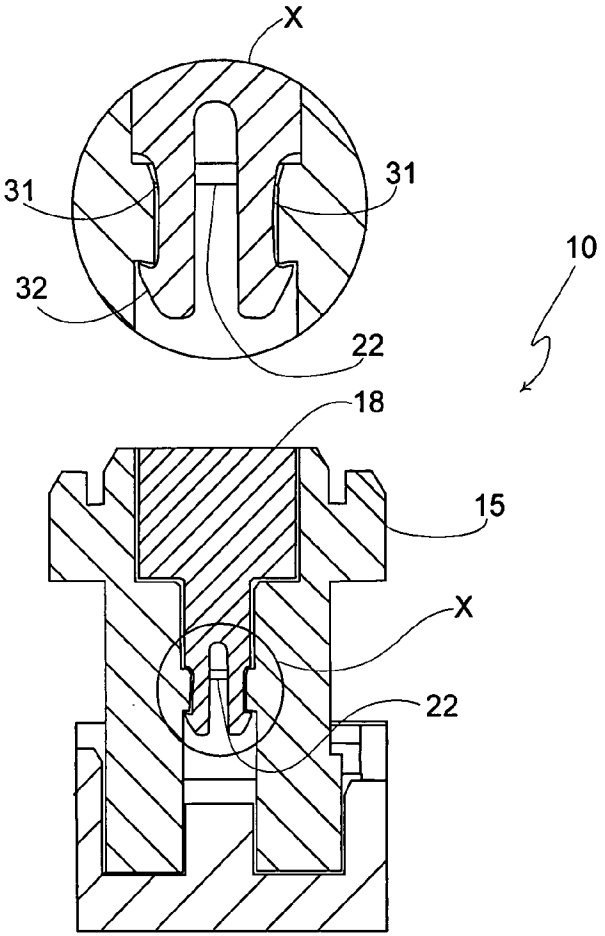
FIGS. 9 & 10 show embodiments of snap locked connections of coding walls in housings of a plug socket.
Figure 9:
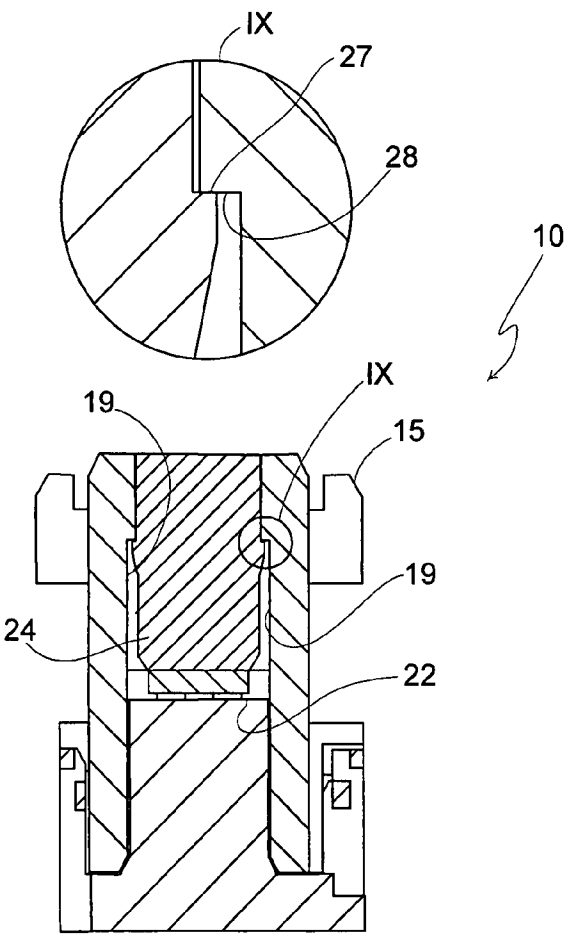

FIG. 9 and FIG. 10 show the housing 10 of the plug socket according to FIG. 6 in a sectional view. FIG. 9 shows the section plane in insertion direction of the face wall 24 in the face wall plane. FIG. 10 shows the section plane in insertion direction of the coding wall 18 in its plane.

FIG. 9 clearly shows the snap locking of the face wall 24 in the housing 10 according to FIG. 6. The guide grooves 19 into which the face wall 24 is inserted for positional stabilization comprise protrusions 28, behind which shoulders 27 reach and snap lock. This is shown particularly clearly in detail IX of FIG. 9.

The snap locking of the coding wall 18 illustrated in FIG. 6 works differently. Also, said coding wall 18 is inserted for positional stabilization into opposite guide grooves 19 provided in the contact support walls 26, the snap locking, however, is performed through an opening in the base 22 of the plug-in opening 12. In the portion of the opening, there are engagement protrusions 31, behind which the snap hooks 32 of the coding wall 18 reach in inserted state. Said condition is clearly shown in the enlarged detail X of FIG. 10.

Figure 11:
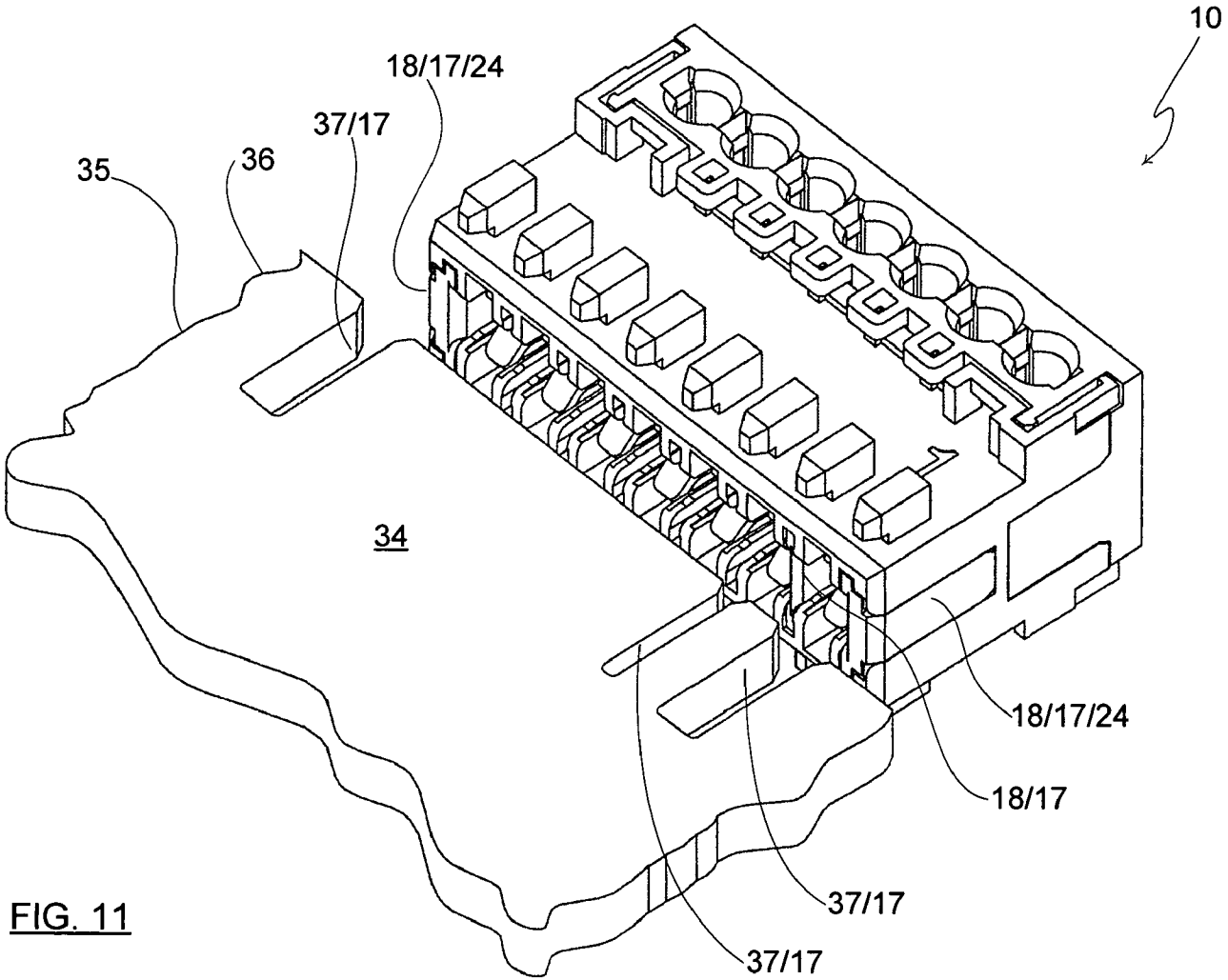
FIGS. 11 & 12 show embodiments of plug sockets with mechanical coding deviating from one another for insertion into contact sections of a circuit board.
Figure 12:
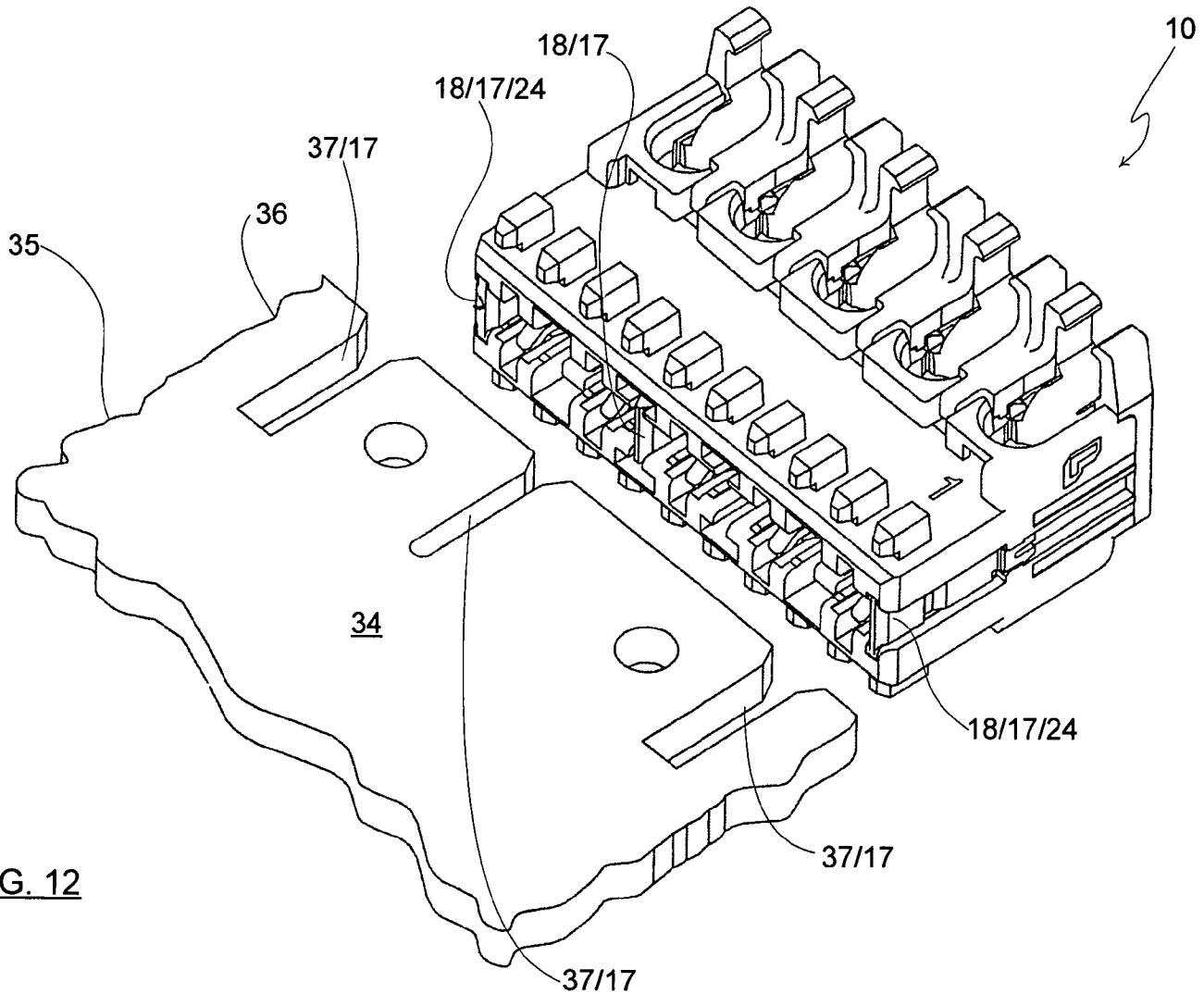

FIGS. 11 and 12 show typical applications for the housing 10 according to the invention. A plug device 35 in the form of a circuit board 34 comprises a contact zone 36 oriented towards the housing 10 with a plurality of conductor paths disposed adjacent to one another which are not shown. The contact zone is recessed by coding devices 17 provided as recesses 37. Coding walls 18 inserted into the insertion opening of the plug-in opening 12 mate with the recesses 37, which coding walls can also be provided in the form of face walls 24. The arrangement is configured, so that the housing 10 can only be placed over the contact zone 36 of the circuit board 34 in one orientation. Thus, the recesses 37 and the coding walls 18 of the housing 10 or of the circuit board 34 are respectively disposed in different positions in FIGS. 11 and 12. Consequently, it is impossible to place the housing 10 of the plug socket of FIG. 12 onto the circuit board 34 of FIG. 11, or to place the housing of FIG. 11 onto the circuit board 34 of FIG. 12. Thus, the coding of the circuit board 34 and of housing 10 is not only used for polarity reversal safe placement at the respective location of the circuit board, but it also prevents the placement of a housing with a different coding.

To sum it up, a contact support 11 in the form of a housing 10 of a plug socket is shown, which can be produced as a standard component and whose coding is subsequently performed with coding devices in the form of coding walls 18. In production, this has the significant advantage that few standard components can be produced without setup times on the production equipment continuously. Contrary to that, when producing prior art plug connectors of said type, the production equipment has to be reconfigured, since the coding walls 18 disposed within the plug in opening 12 are configured integral with the contact support 11.

Furthermore, there is the option to color the coding walls 18, which can be produced in a rather simple manner, and also to implement a color coding through inserting them into a housing 10 with a standard color. The coding walls 18 only have a small volume and can therefore also be easily stored in high volumes. The expensive setup times at production equipment for producing differently colored contact supports 11 or housings 10 become redundant. The plug connector according to the invention with coding devices 17, which are configured as separate components, facilitates much more cost effective production and inventory management.

REFERENCE NUMERALS AND DESIGNATIONS

100 housing of a prior art plug socket
101 plug-in opening
102 contact spring
103 recess
104 material bar
105 cable insertion opening
106 coding wall
107 face wall of 101
108 coding lug
109 contact support wall
10 plug socket housing according to the invention
11 contact support
12 plug-in opening
13 cable insertion opening
14 contact spring
15 coding protrusions
16 cable support
17 coding device
18 coding wall
19 guide grooves
20 wall sections of 18
21 snap lock device
22 bottom of plug in opening
23 narrow sides of 12
24 face walls
25 receiving slot of 12
26 contact support wall
27 snap lock shoulders
28 protrusions of 19
29 reduced material strength zone
30 shortening section
31 snap lock protrusions
32 snap hooks

34 printed circuit board
35 plug device
36 contact zone
37 recess

What is claimed is:

1. A plug connector comprising:

at least one first coding device;

a first contact support including at least one first contact and plural coding device receivers configured to receive the at least one first coding device; and a second contact support including at least one second contact configured to electrically connect with the at least one first contact when the first contact support and the second contact support are joined and including at least one second coding device, wherein the at least one first coding device is configured to be inserted in at least one of the plural coding device receivers of the first contact support so it mates with the at least one second coding device of the second contact support when the first contact support and the second contact support are joined, and wherein the at least one first coding device is configured to be provided in more than two lengths in insertion direction to provide different coding functions.

2. The plug connector according to claim 1, wherein the at least one first coding device can be snap locked in the first contact support.

3. The plug connector according to claim 1, wherein the first contact support comprises guides, which hold the at least one first coding device in position.

4. The plug connector according to claim 1, wherein the first contact support is a housing of a plug socket into which the at least one first coding device is inserted.

5. The plug connector according to claim 4, wherein the housing comprises a snap locking device at a bottom for supporting the at least one first coding device.

6. The plug connector according to claim 4, wherein the at least one first coding device is configured as a coding wall.

7. The plug connector according to claim 6, wherein the housing comprises grooves associated with one another in pairs, in which partial portions of the coding wall inserted into the housing engage for positional stabilization.

8. The plug connector according to claim 6, wherein the coding wall comprises snap locking devices at an end in insertion direction for positional fixation in the housing.

9. The plug connector according to claim 6, wherein the coding wall can be used as a face wall, when the housing is open at its side.

10. The plug connector according to claim 6, wherein the coding wall comprises a shortening section attached through a zone with weakened material, by which the coding wall can be shortened, so that its coding function is changed.

11. The plug connector according to claim 6, wherein the coding wall comprises shoulders at its longitudinal sides contacting the housing, which snap lock with protrusions at the housing.

12. The plug connector according to claim 1, wherein the plug connector complies with RAST 5 or RAST 2.5 Standard.

13. The plug connector according to claim 1, wherein the at least one first coding device is configured colored, wherein the coloring corresponds to a color coding at the second contact support for correct orientation of the contact supports relative to one another.

14. The plug connector according to claim 4, wherein the second contact support is a plug device, in particular a plug or a printed circuit board.

15. The plug connector according to claim 2, wherein the first contact support comprises guides, which hold the at least one first coding device in position.

16. The plug connector according to claim 2, wherein the first contact support is a housing of a plug socket into which the at least one first coding device is inserted.

17. The plug connector according to claim 3, wherein the first contact support is a housing of a plug socket into which the at least one first coding device is inserted.

18. The plug connector according to claim 5, wherein the at least one first coding device is configured as a coding wall.

19. The plug connector according to claim 7, wherein the coding wall comprises snap locking devices at an end in insertion direction for positional fixation in the housing.

20. The plug connector according to claim 7, wherein the coding wall comprises a shortening section attached through a zone with weakened material, by which the coding wall can be shortened, so that its coding function is changed.

* * * * *